United States Patent [19]

Ruhter et al.

[11] Patent Number: 4,664,220

[45] Date of Patent: May 12, 1987

[54] METHOD OF ARRANGING FUNCTION CONTROLS FOR A VEHICLE

[75] Inventors: Martin L. Ruhter; Allan F. Loney, both of Dubuque, Iowa

[73] Assignee: Deere & Company, Moline, Ill.

[21] Appl. No.: 821,384

[22] Filed: Jan. 21, 1986

[51] Int. Cl.[4] ..... B60K 29/00

[52] U.S. Cl. ..... 180/315; 74/493; 180/78; 180/334; 280/775; 172/793

[58] Field of Search ..... 180/315, 321, 322, 326, 180/333, 334, 78; 172/795, 796, 797, 791, 793; 280/775; 74/493

[56] References Cited

U.S. PATENT DOCUMENTS

| | | | |
|---|---|---|---|
| Re. 31,646 | 8/1984 | Beals et al. | 180/78 |
| 2,361,809 | 10/1944 | Batterson | 174/46 |
| 2,777,221 | 1/1957 | Ciabattoni | 172/791 |
| 3,327,413 | 6/1967 | Brinkmeyer et al. | 172/793 |
| 3,550,692 | 12/1970 | Hart | 172/793 |
| 3,737,003 | 6/1973 | Beals et al. | 280/775 |

*Primary Examiner*—Richard A. Bertsch
*Attorney, Agent, or Firm*—Henderson & Sturm

[57] ABSTRACT

A method of arranging function controls for a vehicle, which method provides a control system that is easily converted from a two-hand control for left and right blade lift functions to a one-hand control for the same functions. The method comprises the steps of placing the blade lift levers at the extreme left and right ends of a pivot shaft inserted through the control console, with the third lever for the optional functional control placed adjacent to the right blade lift lever; and placing the left and right blade lift control valves at opposite ends of the control valve stack similarly to the placement of the left and right control levers, with the optional functional control valve placed adjacent to the right blade lift control valve as with the optional control lever. The hydraulic fittings for the left blade lift function valve and the optional functional control valve are reversible, such that to convert the control pattern from the two-hand pattern to the one-hand pattern for the blade lift levers, the operator merely needs to reverse the hydraulic fittings for the left blade lift function valve and the optional functional control valve. A re-identification of the levers the control valves of which have been reversed is helpful to the operator in utilizing the controls.

5 Claims, 8 Drawing Figures

46
61
56
39
54
20a
37
36
61
20
56
54
38
58
22
57
33
34
16
10
14
59
17
51
47
18
49
48
11
12
13
15
19

METHOD OF ARRANGING FUNCTION CONTROLS FOR A VEHICLE

TECHNICAL FIELD

This invention relates to an earth moving vehicle, such as a motor grader, and more particularly to a method of arranging function controls for the vehicle to provide at least two basic control patterns.

BACKGROUND ART

The usual motor grader vehicle with which this invention is concerned has controls for the functional elements of the vehicle which include a control console pivotally mounted on the floor of the operator's station having an elongated pivot shaft which extends transversely through the console and which has exposed ends to the left and right of the console as viewed by the operator sitting or standing behind same. A plurality of function control handles are mounted in a side-by-side arrangement on both exposed ends of the pivot shaft, each handle having a knob mounted on the upper end thereof which has a function indicia formed thereon such that when viewed by the operator, the purpose of the handle is readily seen.

The handles are each connected as by linkage or the like with a function control valve which is usually mounted closely adjacent the lower ends of the linkage arrangements. In the instant motor grader, a stack of function control valves are mounted together in a transverse side-by-side arrangement forwardly of the control console, each valve having a hydraulic fitting operably connected by hydraulic lines and the like to the respective functional elements of the vehicle for which a particular function valve is provided. Further, the prior art shows that each set of control handles and control valves may include a first handle for operating a left blade lift control valve, a second handle for operating a right blade lift control valve, and a third handle for an optional functional control valve, each of these three specified control valves having a "float" condition built into the valve for maintaining its respective functional elements in a "float" condition.

From a variety of control handle arrangements of control levers, the variety of arrangements existing even though the control functions of a vehicle such as a motor grader may be the same for the motor graders of a variety of manufacturers, two basic control patterns evolve: one comprising a two-hand control for the left and right blade lift functions, and the other comprising a one-hand control arrangement for the left and right blade lift functions. As customer and operator acceptance has varied between the two alternative control patterns, this invention comprises a new and novel method of arranging the function controls whereby conversion from one control pattern to the other is readily obtainable without rearranging the control valve stack.

DISCLOSURE OF THE INVENTION

The present invention is a method of arranging function controls for a vehicle such as a motor grader, which method provides a control system that is easily converted from a two-hand control for left and right blade lift to a one-hand control for left and right blade lift. The method comprises the steps of placing or locating the blade lift handles or levers placed at the extreme left and right ends of the lever pivot shaft inserted through the control console, with the third lever for the optional functional control placed adjacent to the right blade lift lever. Thus the two-hand control pattern places the blade lift levers at extreme ends of that control pattern. In this pattern, the left blade lift control valve and the right blade lift control valve are placed on opposite ends of the control valve stack similarly to the placement of the left and right control levers, and with the optional functional control valve placed adjacent to the right blade lift control valve. In this manner, the control valves for the blade lift levers and the optional functional lever are placed in the same arrangement as their respective levers.

By rendering the hydraulic fittings for the left blade lift function valve and the optional functional control valve reversible, to accommodate both blade lift control patterns with only one control valve stack, the left blade lift valve and the optional control valve are merely reversed, as by their fittings being reversed, since both require float positions. This minimizes the conversion to only the switching of the valve hydraulic fittings and a re-identification of the levers.

BRIEF DESCRIPTION OF THE DRAWINGS

These and other attributes of the invention will become more clear upon a thorough study of the following description of the Best Mode for Carrying Out the Invention, particularly when reviewed in conjunction with the drawings, wherein.

BEST MODE FOR CARRYING OUT THE INVENTION

Figure 1A:
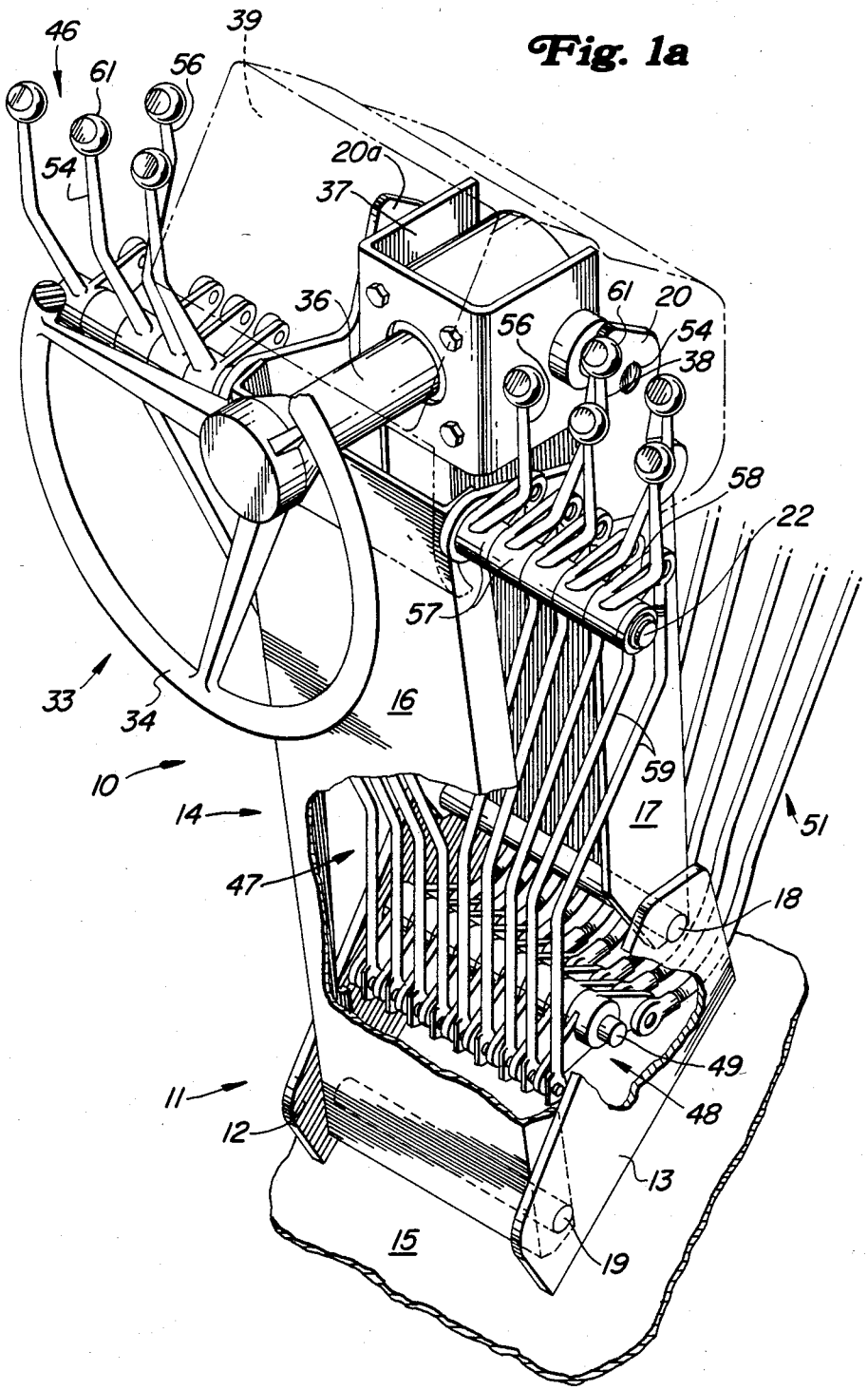
FIG. 1A is a front perspective view of a portion of the control console of this invention.

Referring now to the drawings, wherein like reference numerals designate identical or corresponding parts throughout the several views, the adjustable control console to which this invention relates is indicated generally at (10) in FIG. 1A. The console (10) is adapted to be mounted on the floor (15) of the operator's station of a vehicle, such as a motor grader, with the operator's seat (not shown) immediately to the rear or to the left as viewed in FIG. 1A, of the console (12). The vehicle itself may be of conventional construction and thus is not described herein, a suitable example of a motor grader vehicle being described in U.S. Pat. No. 3,450,213.

The console (10) holds a support bracket (11) comprising a pair of transversely spaced bracket plates (12)

and (13) mounted on the floor (15) of the operator's station in an upstanding manner, includes further a pedestal unit (14) pivotally mounted on the plates (12) and (13) and having first and second longitudinally spaced upwardly extended, U-shaped panels (16) and (17), respectively, each panel having a lower end which is pivotally mounted on one of a first pair of horizontally and longitudinally spaced transverse shafts (18) and (19) which are secured to and extended between the bracket plates (12) and (13).

Figure 1B:
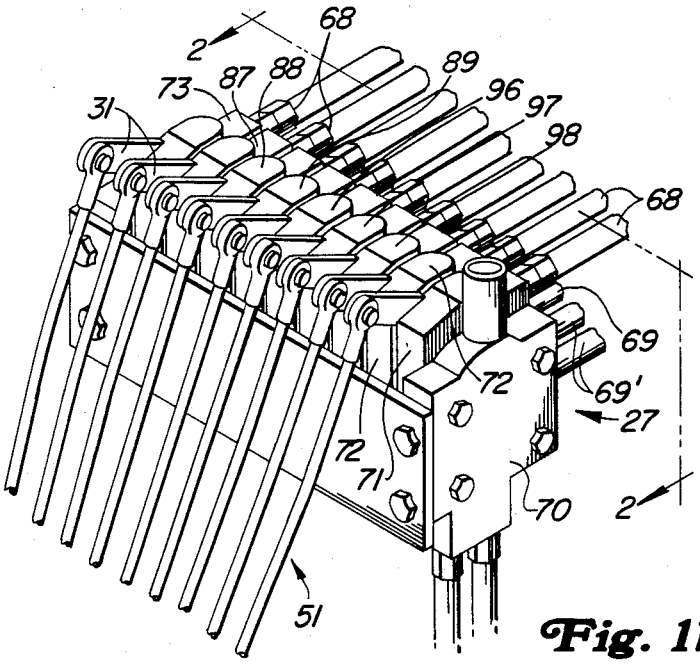
FIG. 1B is a front perspective view of the remainder of control linkages shown in FIG. 1A, and showing a stack of control valves as a part of the invention.
Figure 2:
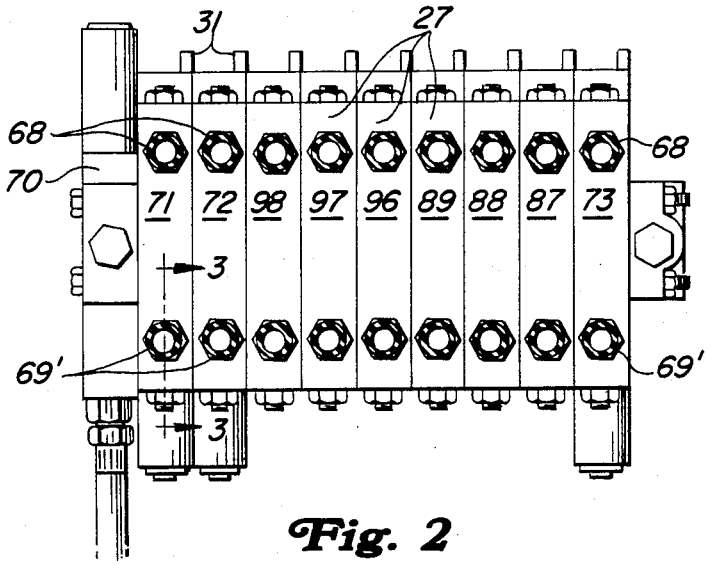
FIG. 2 is a plan view of the control valve stack of FIG. 1B.

The pedestal unit (14) includes further a second pair of horizontally and longitudinally spaced transverse shafts (one not showing) and (22) to which are pivotally connected the upper ends of the panels (16) and (17) as is clearly shown in FIG. 2. A pair of transversely spaced T-shaped mounting links (20) and (20*a*) are pivotally mounted at their fore and aft ends to the front and rear upper shafts (one not showing) and (22), respectively. A locking unit (not shown) (FIG. 1) is provided for releasably locking the pedestal unit (14) in one of several adjusted positions as determined by the needs of the operator, with a release mechanism (not shown) provided with a rearwardly extending handle (not shown) for manipulation by the operator in order to release the locking unit thereby enabling the operator to pivot the entire console (10) forwardly or rearwardly about the support bracket (11).

Spaced forwardly of the console (10) and spaced further above the support bracket (11) are a plurality of hydraulic control valves (27) (FIG. 2), which valves are mounted as a unit on a plate (28) secured to the forward portion (not shown) of the operator's station or cab. Each valve (27) is provided with an actuator arm (31) mounted for movement in a vertical plane such that upward or downward movement of the actuator arm (31) operates the valve (27) in such a manner to control a predetermined function or functions of the motor grader vehicle.

Carried on the mounting plates (20) and (20*a*) is a steering unit (33) comprising a steering wheel (34), steering column (36) and hydraulic steering mechanism (37), the unit (33) being mounted for pivotal movement in relation to the pedestal unit (14) by means of a transverse shaft (38) secured to the links (20) and (20*a*). A conventional hood (39) is provided for covering the steering unit (33), which hood may carry the necessary instruments and gauges for indicating the status of the functioning of the various components of the vehicle. The steering unit (33) is normally provided with mechanism (not shown) for providing adjustable movement of the steering unit (33) relative to the pedestal unit (14) and regardless of the angle of inclination of the pedestal unit (14).

Although not shown herein, locking means and release means are provided for the control console (10) such that the operator may move the console (10) from one of an adjusted, locked position relative to the floor (15) to another locked, adjusted position as is determined by the needs of the operator in controlling the functions of the vehicle. Co-pending application, Ser. No. 06/821,387, filed Jan/ 21, 1986, discloses all of the locking and release mechanism units for operating the console (10) as illustrated in FIG. 1A.

The control linkage of this invention includes a lever unit indicated generally at (46) in FIG. 1A which is pivotally mounted on the outer, transverse ends (52) and (53) (FIG. 4) of the upper rear shaft (22); a link assembly indicated generally at (47) which is pivotally connected to the lever unit (46) and depends therefrom; a bell crank unit indicated generally at (48) which is pivotally connected to the lower ends of the link assembly (47) and pivotally mounted itself on a transversely disposed shaft (49) mounted to and extended between the bracket plates (12) and (13); and a rod assembly indicated generally at (51) in FIGS. 1A and 1B which is pivotally mounted to the bell crank unit (48) at the lower ends thereof and to the respective actuator arm (31) (FIG. 1B) of the control valves (27) at the upper ends thereof. Generally, movement by the operator of any one lever of the lever unit (46) is operable due to the link assembly (47), bell crank unit (48) and rod assembly (51) to operate a respective valve (27), thus resulting in operation of the chosen one or set of functional elements of the vehicle.

Figure 5:
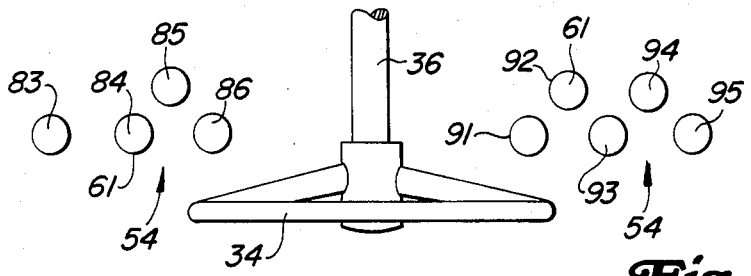
FIG. 5 is a schematic view of the knobs of the control levers of FIG. 4 in relation to a steering wheel carried by the control console.
Figure 4:
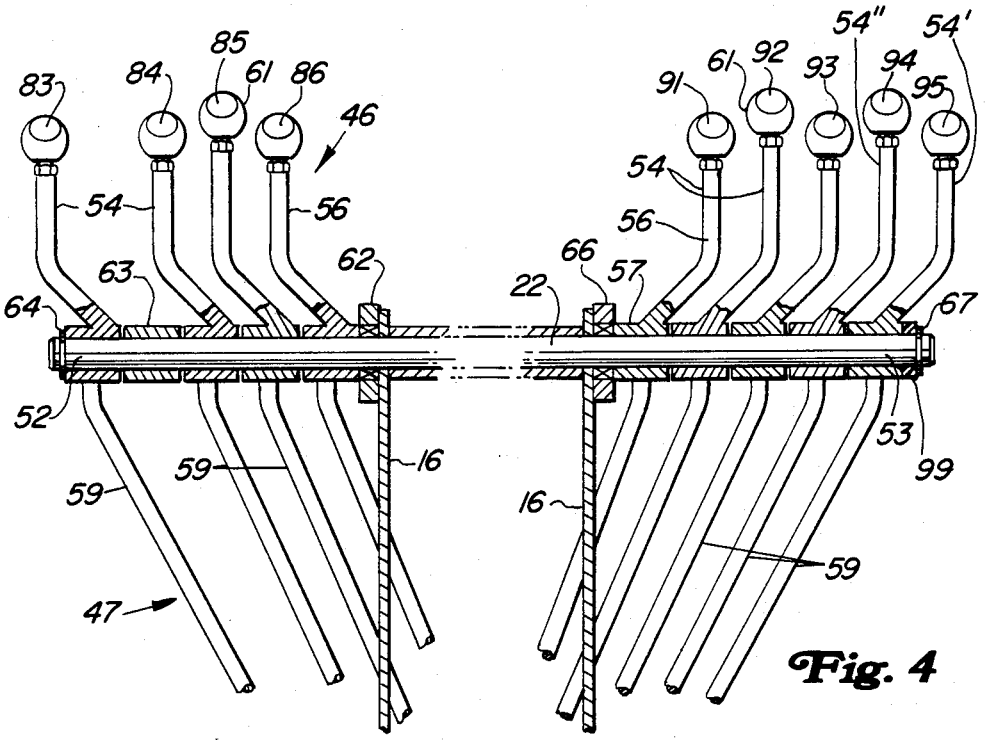
FIG. 4 is a sectional view along a pivot shaft of the control console showing one pattern of control levers.

More particularly, the lever unit (46) comprises a plurality of control levers (54) (Fig. 1A and 4) which are mounted in a side-by-side arrangement on the left and right ends (52) and (53), respectively, of the pivot shaft (22). Each control lever (54) includes an arm (56) extending upwardly from a bearing boss (57) pivotally mounted on the respective shaft (22) end (52) or (53), with each boss (57) having a relatively short crank arm (58) extending forwardly therefrom for connection with the upper end of an associated one of the series of control links (59) which comprise the link assembly (47). At the upper end of each lever (54), a knob (61) is provided which may be grasped by the operator. To include a maximum number of control levers (54) in a minimum space with adequate clearance between each knob (61) for the appropriate gripping thereof by the hand of the operator, the levers (54) are arranged in two groups in which one group, consisting of alternate ones of the levers is angled to situate the knobs thereof forwardly from the knobs (61) of the intervening ones of the levers which constitute the other group. As best seen in Figs. 1A, 4 and 5, alternate groups of levers (54) and knobs (61) are shown. Referring to FIG. 4, it will be seen that one group of levers (54) mounted on the left end shaft (52) have a bearing (62) spacing the levers from the adjacent portion of the panel (16), a spacer (63) being provided between the outer two levers (54), and with a snap ring (64) being attached to the outer end of the shaft (52). Removal of the snap ring (64) provides for easy sliding off, and replacement, of any one or more of the levers (54) in that group. The group of levers (54) to the right side of the panel (16) as viewed in FIG. 4 also includes a bearing (62) against the panel (16) and an appropriate snap ring (66) at the outer end for the same reasons as set forth with respect to the left hand group of levers (54).

Referring to FIGS. 1B and 2, it is seen that the control valves (27) are arranged in a transversely extended, side-by-side stack of control valves which are mounted together. Although not seen, the stack of control valves (27) is mounted on the cab (not shown) within which the control console (10) is mounted, forwardly of the console (10). Each valve (27) has upper and lower hydraulic fittings (68) and (69) for passage of fluid therethrough to and from the valve (27) for effecting operation of the functional elements which that particular valve (27) controls. A priority valve (70) is shown mounted at the right end of the stack of valves (27) as viewed in FIG. 1B; however, the priority valve (70) is not a part of this invention.

Figure 3:
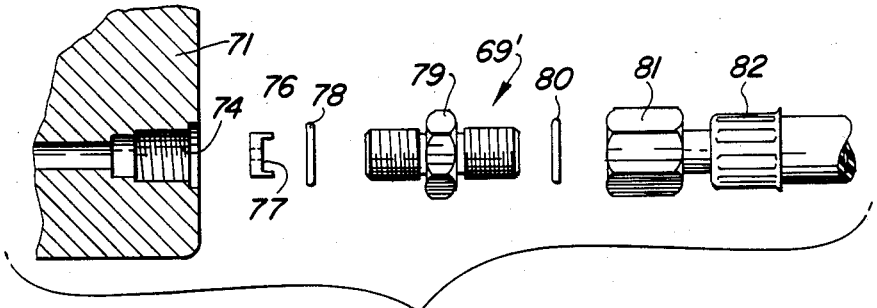
FIG. 3 is an enlarged exploded view taken along the line 3—3 in FIG. 2, and showing a hydraulic fitting unit for one of the "float" type valves provided for the stack.

Special valves (71), (72) and (73) (FIG. 2) are provided, these special valves including structure for providing a "float" position of the respective functional elements which they control. The lower hydraulic fitting (69') of each special valve (71–73) is distinctive from the lower hydraulic fittings (69) for the remainder of the valves (27), and is shown in exploded view in FIG. 3. Each special valve lower hydraulic fitting (69') being the same, only one will be described.

The fitting (69') is adapted to be threadably mounted in an internally threaded port (74) formed therefor in the special valve (71), and includes a circular orafice plate (76) having a slot (77) formed therein, an "O" ring (78), fitting (79), "O" ring (80), connecting nut (81) and hydraulic hose (82) connected in conventional manner to the nut (81).

Referring particularly to FIGS. 4 and 5 showing a first control pattern for the levers (61), the invention comprises the location of the levers (61) and their respective control valves (27) in the control pattern as illustrated in FIGS. 4 and 5. The control knobs (83), (84), (85) and (86) shown in the left group of control levers (54) of FIG. 5 are located as illustrated, and are each directly linked to the control valves (73), (87), (88) and (89) of the stack of control valves shown in FIG. 2. The group of levers (54) shown on the right side of the steering wheel (34) in FIG. 5 are arranged as illustrated, the knobs being (91), (92), (93), (94) and (95); and these knobs (91–95) are directly connected control valves (96), (97), (98), (72) and (71).

The valve (73) is operably connected with the left blade lift functional elements (not shown) of the vehicle, the special control valve (72) is operably connected with an optional functional element or elements for the vehicle (not shown), and the special control valve (71) is operably connected to the right blade lift function (not shown) of the vehicle. Thus, by placing the blade lift levers (83) and (95) at the extreme left and right ends (52) and (53) of the lever pivot shaft (22), with the lever (94) for the optional functional control placed adjacent to the right blade lift lever (95), two-hand control pattern for the blade lift function of the motor grader is provided.

Figure 6:
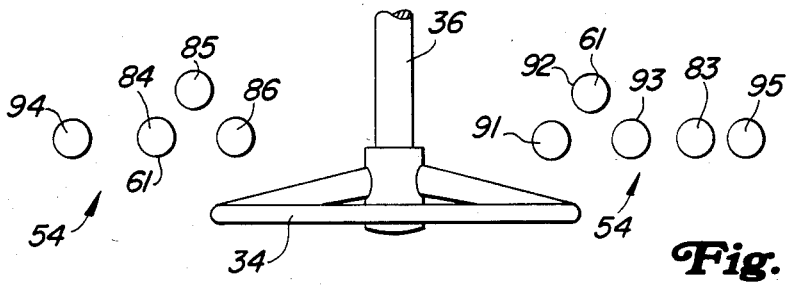
FIG. 6 is a schematic showing a second control pattern of levers.

To convert the two-hand control pattern to a one-hand control pattern for the blade lift functions, as is preferred by some operators, the upper (68) and lower (69') hydraulic fittings for the valves (73) and (72) are merely reversed. Assuming the fittings (69') for the valves (72) and (73) are identical, the reversal merely requires disconnecting each set of upper and lower fittings (68) and (69') for each of the valves (73) and (72), reversing the fittings and reconnecting them. Thus, the valve (73), formerly for the left blade lift function now becomes the control function for the optional function of the vehicle, and the valve (72), formerly for the optional function now becomes the control valve for the left blade lift cylinder function. This therefore places the blade lift levers (54) in a side-by-side arrangement at the right side of the steering wheel (34) as viewed in FIG. 6, and with the optional function lever (94) being placed at the extreme left side of the steering wheel (34) again as illustrated in FIG. 6. Thus, the knob (83) is now immediately adjacent and to the inside of the knob (95), (83) for the left blade lift function and knob (95) for the right blade lift function, and knob (94) for the optional function control is placed as illustrated in FIG. 6 in the location where the knob (83) was formerly located. It will be noted that levers and knobs are not necessarily relocated, only the indicia indicating the function of the knobs (83) and (94) being changed. It is to be emphasized that the main change in the control arrangement required for converting the two-hand control for the blade lifts to the one-hand control therefor is a reversal of the hydraulic fittings for the control valves (72) and (73). If any of those fittings are different from the others, that must be taken into account as to changes required in the plumbing for the conversion process.

Figure 7:
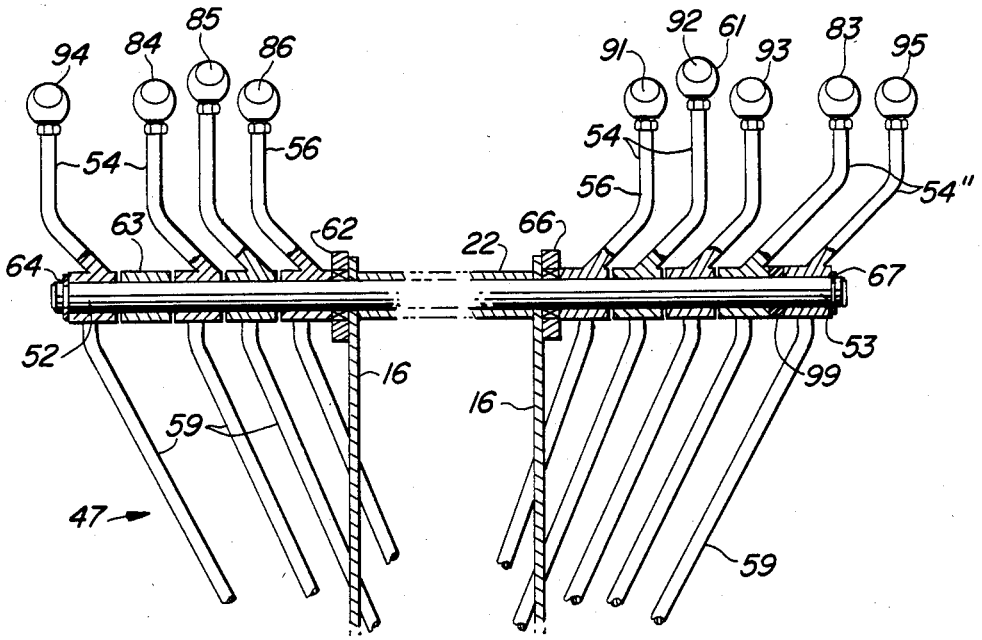
FIG. 7 is a view similar to FIG. 4 showing the position and placement of the levers in the second control pattern of FIG. 6.

Referring to FIG. 6, it is seen that the knob (83) for the left blade lift function may be placed side-by-side with the knob (95) for the right blade lift function. This requires a removal of the lever (54) on which the knob (94) (FIG. 5) was mounted, and the utilization of a lever (54) identical to the lever (54) used for the placement knob (95). This particular arrangement of identical levers (54') for the knobs (83) and (95) is shown in FIG. 7. To provide proper spacing between the levers (54'), a spacer bearing (99) (FIG. 4) initially used at the right end (53) of the shafts (22) is removed therefrom, the snap rings (67) having been removed, the lever (54') for the knob (95) pulled off the shaft end (53), and with the spacer bearing (53) being inserted between the levers (54) after the lever (54) for the knob (83) has been inserted onto the shaft end (53) in the place of the original lever (54") (FIG. 4).

We claim:

1. Controls for the functional elements of a vehicle such as a motor grader comprising:

a control console pivotally mounted on the floor of the operator's station;

an elongated pivot shaft extended transversely through the console and having exposed ends left and right of the console as viewed by the operator behind the console;

a plurality of control levers mounted in a side-by-side arrangement on both exposed shaft ends, each lever having a function indicia theron;

a stack of function control valves mounted together in a transverse side-by-side arrangement forwardly of the control console, each valve having a hydraulic fitting operably connecting the valve to its respective function elements of the vehicle, each lever operably connected by linkage to a respective control valve whereby movement of a lever operates the particular valve to which it is connected, a first lever for operating a left blade lift control valve, a second lever for operating a right blade lift control valve, and a third lever for an optional function control valve, each of these three specified control valves having a "float" condition built therein:

said first lever and said second lever located on opposite ends of said pivot shaft;

said third lever located on said pivot shaft next adjacent said second lever;

said left blade lift control valve and said right blade lift control valve disposed at opposite ends of said control valve stack similar to the respective locations of said first and second levers;

said optional functional control valve disposed next adjacent said right blade lift control valve; and hydraulic fittings for said left blade lift function valve and said optional functional control valve reversible with each other.

2. The invention of claim 1 and further wherein said third lever is located next adjacent, inwardly and spaced forwardly of said second lever.

3. The invention of claim 1 and further wherein said hydraulic fittings for said left blade lift control valve and said optional functional control valve are reversed, and the indicia for said first lever and said third lever are reversed.

4. The invention of claim 3 and further wherein said re-identified third lever, now identified as said first lever is placed in transverse alignment with said second lever.

5. The invention of claim 4 and further wherein said new first lever is spaced transversely from said second lever more than the transverse spacing of said second lever and said original third lever.

* * * * *